US008210531B2

(12) United States Patent
Nitta

(10) Patent No.: US 8,210,531 B2
(45) Date of Patent: Jul. 3, 2012

(54) SHEET-FED PRINTING PRESS

(75) Inventor: Masao Nitta, Hiroshima-ken (JP)

(73) Assignee: Ryobi Ltd., Hiroshima-ken (JP)

( * ) Notice: Subject to any disclaimer, the term of this patent is extended or adjusted under 35 U.S.C. 154(b) by 1034 days.

(21) Appl. No.: 12/167,965

(22) Filed: Jul. 3, 2008

(65) Prior Publication Data

US 2009/0007808 A1 Jan. 8, 2009

(30) Foreign Application Priority Data

Jul. 5, 2007 (JP) ..... 2007-177245

(51) Int. Cl.
*B65H 5/02* (2006.01)
*B41F 21/00* (2006.01)

(52) U.S. Cl. ..... 271/277; 271/275; 101/409

(58) Field of Classification Search ..... 101/407.1, 101/408, 409, 411, 246; 271/275, 277
See application file for complete search history.

(56) References Cited

U.S. PATENT DOCUMENTS

| | | | | |
|---|---|---|---|---|
| 4,873,926 | A | 10/1989 | Simeth et al. | |
| 5,694,849 | A * | 12/1997 | Wehle et al. | 101/233 |
| 6,659,008 | B2 * | 12/2003 | Mutschall et al. | 101/409 |
| 7,090,216 | B2 * | 8/2006 | Becker | 271/277 |
| 7,107,904 | B2 * | 9/2006 | Kusaka | 101/409 |
| 7,320,281 | B2 * | 1/2008 | Becker et al. | 101/409 |
| 2008/0276815 | A1 * | 11/2008 | Schmidt | 101/409 |

FOREIGN PATENT DOCUMENTS

| | | |
|---|---|---|
| DE | 3632768 C1 | 1/1988 |
| EP | 073955 A1 | 3/1983 |
| JP | 63-254038 | 10/1988 |
| JP | 2006-315229 | 11/2006 |

* cited by examiner

*Primary Examiner* — Kaitlin Joerger
(74) *Attorney, Agent, or Firm* — The Webb Law Firm

(57) ABSTRACT

It is an object of the present invention to provide a sheet-fed printing press that prevents occurrence of troubles, such as damages of a surface treatment member such as a film for the surface treatment of, for example, a sheet of paper, by a simple structure. A gripping surface of a claw block provided in a cylinder of a treatment section is formed into an inclined surface that comes closer to the rotational axis as it advances downstream in a sheet conveying direction of the cylinder, so as not to have the gripper of the cylinder contacting the treatment means. A gripping surface of a claw block provided in a cylinder most adjacent to the treatment section, of plural cylinders, is formed into an inclined surface that, projects further through an outline of this cylinder as it advances downstream in the sheet conveying direction. A gripping surface of a claw block provided in the cylinder closest to a printing impression cylinder is formed into an inclined surface inclined at an angle smaller than the inclined angle of the gripping surface of the claw block of the cylinder provided in the treatment section.

6 Claims, 8 Drawing Sheets

SHEET-FED PRINTING PRESS

CROSS REFERENCE TO RELATED APPLICATION

This application claims priority from Japanese Patent Application No. 2007-177245, which is incorporated herein by reference.

BACKGROUND OF THE INVENTION

1. Field of the Invention

The present invention relates to a sheet-fed printing press that includes a treatment section that includes a cylinder having a gripper for gripping each of oncoming sheets by a claw block and a claw, and a treatment means for treating the sheet in proximity to or in contact with the surface of the sheet, which is conveyed while being gripped by the gripper to the downstream side in a sheet conveying direction, and plural cylinders disposed between the treatment section and a printing impression cylinder disposed upstream or downstream of the treatment section in a sheet conveying direction, each cylinder including a gripper having the same structure as that of the aforesaid gripper.

As used herein, directional terms, "downstream" and "upstream" are used with reference to a sheet conveying direction unless otherwise specified.

2. Related Art

For example, there was already proposed a sheet-fed printing press that includes a casting device as an example of the aforesaid treatment section. This printing press has a varnishing unit disposed downstream of a printing unit in the sheet conveying direction, and a hologram forming unit disposed downstream of the varnishing unit in the sheet conveying direction. With this arrangement, a sheet of paper (hereinafter referred simply to a sheet), which is printed during passing between a blanket cylinder and an impression cylinder, of a printing unit, is transferred to an impression cylinder, which constitutes a varnishing unit, via a transfer cylinder and then varnished. Subsequently, a printed and varnished sheet is transferred to an impression cylinder, which constitutes a hologram forming unit, via a transfer cylinder, at which hologram surface is formed by pressing hologram pattern on a varnishing layer and at the same time the varnishing layer is cured by a UV radiation means, thus forming hologram (cf. Patent Document 1, for example).

(Patent Document 1) Japanese Patent Application Laid-open No. 2006-315229 (cf. FIGS. 1-3)

(Patent Document 2) Japanese Patent Application Laid-open No. Sho-63-254038 (cf FIGS. 8 and 9)

According to the disclosure of the Patent Document 1, the transferring of each sheet from the impression cylinder to the transfer cylinder and the transferring of each sheet from the transfer cylinder to the impression cylinder are carried out by the grippers of the respective cylinders, each gripper composed of a claw block and a claw. Each of these grippers, which is to convey each sheet by gripping the same along the outer circumference of the corresponding cylinder, has claws greatly projecting through the outline of the cylinder when they are kept in sheet gripping state. Therefore, when a film is pressed to the side of the impression cylinder via a printed sheet while conveying the printed sheet by gripping the same by the gripper of the impression cylinder of the hologram forming unit, the film is likely to contact the claw of the projecting gripper and hence is damaged, for which improvement is desired.

By the outline is herein meant an imaginary outer boundary of a corresponding cylinder, which corresponds to the circumference of a corresponding cylinder, and extends also through an area(s) of the circumference, where a physical circumferential surface does not exist.

Meanwhile, it is conceivable that the gripper is designed to be movable so that it is located inside of the impression cylinder during the film is pressed to the side of the impression cylinder via the printed sheet by a pressing roller. However, this arrangement is disadvantageous in the fact that it is necessary not only to design the gripper to be movable between a receiving position for receiving an oncoming printed sheet and a retracted position to which the gripper is retracted upon receiving the sheet, but also to provide an actuator for moving the gripper to the aforesaid two positions and a control unit or the like for controlling the operation of the actuator, which leads to a complicated structure. Thus, this arrangement is unlikely to he employed in practice.

SUMMARY OF THE INVENTION

In consideration of the above circumstances, it is an object of the present invention to provide a sheet-fed printing press that prevents occurrence of troubles, such as damages of a surface treatment member such as a film for the surface treatment of, for example, a sheet of paper, by a simple structure.

According to one aspect of the present invention, there is provided a sheet-fed printing press that includes a treatment section that includes a cylinder having a gripper for gripping each of oncoming sheets by a claw block and a claw, and a treatment means for treating the sheet in proximity to or in contact with the surface of the sheet conveyed downstream in a sheet conveying direction while being gripped by the gripper, and plural cylinders disposed between the treatment section and a printing impression cylinder disposed upstream of the treatment, section in the sheet conveying direction, each cylinder including a gripper having the same structure as that of the gripper, wherein a gripping surface of the claw block provided in the cylinder of the treatment section is formed into an inclined surface that comes closer to the rotational axis as it advances downstream in the sheet conveying direction of the cylinder, so as not to have the gripper of the cylinder contacting the treatment, means, a gripping surface of a claw block provided in the cylinder most adjacent to the treatment section, of the plural cylinders, is formed into on inclined surface that projects further through an outline of the cylinder as it advances downstream in the sheet conveying direction, a gripping surface of a claw block provided in the residual cylinder upstream of and adjacent to the cylinder is formed into an inclined surface that comes closer to the rotational axis as it advances downstream in the sheet conveying direction of the cylinder, and a gripping surface of a claw block provided in the cylinder closest to the printing impression cylinder is formed into an inclined surface inclined at an angle smaller than the inclined angle of the gripping surface of the claw block of the cylinder provided in the treatment section.

According to another aspect of the present invention, there is provided a sheet-fed printing press that includes a treatment section that includes a cylinder having a gripper for gripping each of oncoming sheets by a claw block and a claw, and a treatment means for treating the sheet in proximity to or in contact with the surface of the sheet conveyed while being gripped by the gripper to the downstream side in a sheet conveying direction, and plural cylinders disposed between the treatment section and a printing impression cylinder disposed downstream of the treatment section in the sheet conveying direction, each cylinder including a gripper having the same structure as that of the gripper, wherein a gripping surface of the claw block provided in the cylinder of the treatment section is formed into an inclined surface that comes closer to the rotational axis as it advances downstream in the sheet conveying direction of the cylinder, so as not to have the gripper of the cylinder contacting the treatment means, a gripping surface of a claw block provided in the cylinder most adjacent to the treatment section, of the plural cylinders, is formed into an inclined surface that projects further through an outline of the cylinder as it advances downstream in the sheet conveying direction, a gripping surface of a claw block provided in the residual cylinder downstream of and adjacent to the cylinder is formed into an inclined surface that comes closer to the rotational axis as it advances downstream in the sheet conveying direction of the cylinder, and a gripping surface of a claw block provided in the cylinder closest to the printing impression cylinder is formed into an inclined surface inclined at an angle smaller than the inclined angle of the gripping surface of the claw block of the cylinder provided in the treatment section.

With the arrangement in which the gripping surface of the gripper is formed into an inclined surface that comes closer to the rotational axis as it advances downstream in the sheet conveying direction of the cylinder, so as not to have the gripper of the cylinder contacting the treatment means, it is possible to prevent the treatment means (a member for surface treatment, such as a film) from hitting against the claw of the gripper, when the surface of each sheet, which is being conveyed downstream while being gripped by the gripper to the downstream side in the sheet conveying direction, is being treated by the treatment means that is located in proximity to or in contact with the surface of the sheet. Furthermore, with the arrangement in which a gripping surface of a claw block provided in the cylinder closest to the printing impression cylinder, of the plural cylinders, is formed into an inclined surface inclined at an angle smaller than the inclined angle of the gripping surface of the claw block of the cylinder provided in the treatment, section, printing can be made with high registration accuracy, and the sheet gripping positions of the adjacent cylinders are not greatly misaligned from each other in the sheet thickness direction, thereby achieving smooth transferring of sheets between the adjacent cylinders without causing damages to sheets, or causing creases or wrinkles in sheets. By the treatment section is meant herein a device for treating sheets, such as transferring gold foil, embossed pattern, hologram pattern or the like onto sheets by pressing a transfer film onto the surface of each conveyed sheet, a device for corona treatment to allow the sheets to take ink well, a device for forming perforations on the sheets, a device for cutting the sheets, a device for creasing the sheets, and the like.

The inclined angle of each of the gripping surfaces of the claw blocks of the cylinders becomes smaller for the cylinder closer to the printing impression cylinder.

The inclined angle of each of the gripping surfaces of the claw blocks of the cylinders becomes smaller by a predetermined constant angle for the cylinder closer to the printing impression cylinder away from the treatment section.

The inclined angle of the inclined surface of the claw block of the printing impression cylinder is set at 0°.

According to still another aspect of the present invention, there is provided a sheet-fed printing press that includes a treatment section that includes a cylinder having a gripper for gripping each of oncoming sheets by a claw block and a claw, and a treatment means for treating the sheet in proximity to or in contact with the surface of the sheet conveyed while being gripped by the gripper to the downstream side in a sheet conveying direction, and plural cylinders disposed between the treatment section and a printing impression cylinder disposed upstream of the treatment section in the sheet conveying direction, each cylinder including a gripper having the same structure as that of the gripper, wherein the gripper of the cylinder of the treatment section is located at a position retracting from an outline of the cylinder, a gripping surface of a claw block of a first cylinder most adjacent to the treatment section, of the plural cylinders, is located at a position projecting through an outline of the first cylinder, a gripping surface of a claw block of a second cylinder upstream of and adjacent to the first cylinder is located at a position retracting from the projecting position of the claw block of the first cylinder, and the projecting or retracting amount of the gripping surface of the claw block of the cylinder closest to the printing impression cylinder is set to be smaller than the projecting or retracting amount of the gripping surface of the claw block of each of the residual cylinders.

With the arrangement in which the gripper of the cylinder of the treatment section is located at a retracted position so as not to protrude through an outline of the cylinder, it is possible to prevent a member for surface treatment, such as a film, from hitting against the claw of the gripper, when the surface of each sheet, which is being conveyed downstream while being gripped by the gripper to the downstream side in the sheet conveying direction, is being treated by the treatment means that is located in proximity to or in press contact with the surface of the sheet. Furthermore, with the arrangement in which the projecting or retracting amount of the gripping surface of the claw block of the cylinder closest to the printing impression cylinder, of the plural cylinders, is set to be smaller than the projecting or retracting amount of the gripping surface of the claw block of each of the residual cylinders, printing can be made with high registration accuracy, and the sheet gripping positions of the adjacent cylinders in the sheet thickness direction are not greatly misaligned from each other, thereby achieving smooth transferring of sheets between the adjacent cylinders without causing damages to sheets, or causing creases or wrinkles in sheets.

With the arrangement in which the gripping surface of the gripper is formed into an inclined surface that comes closer to the rotational axis as it advances downstream in the sheet conveying direction of the cylinder, so as not to have the gripper of the cylinder contacting the treatment means, or with the arrangement in which the gripper of the cylinder of the treatment section is located at a retracted position so as not to protrude through an outline of the cylinder, it is possible to prevent a member for surface treatment, such as a film from hitting against the claw of the gripper, when, for example, the surface of each sheet, which is being conveyed downstream while being gripped by the gripper to the downstream side in the sheet conveying direction, is being treated by pressing the surface treatment means onto the surface of each conveyed sheet. Therefore, it is possible to securely prevent troubles, such as damages to, for example, a surface treatment member by a simplified structure, as compared with the arrangement in which the gripper is moved into the cylinder. Furthermore, with the arrangement in which a gripping surface of a claw block provided in the cylinder closest to the printing impression cylinder, of the plural cylinders, is formed into an inclined surface inclined at an angle smaller than the inclined angle of the gripping surface of the claw block of the cylinder provided in the treatment section, or with the arrangement in which the projecting or retracting amount of the gripping surface of the claw block of the cylinder closest to the printing impression cylinder is set to be smaller than the projecting or retracting amount of the gripping surface of the claw block of each of the residual cylinders, printing can be made with high registration accuracy, and smooth transferring of sheets between the adjacent cylinders can he made as in a conventional manner.

With the arrangement in which the inclined angle of each of the gripping surfaces of the claw blocks of the cylinders becomes smaller for the cylinder closer to the printing impression cylinder away from the treatment section, or with the arrangement in which the inclined angle of each of the gripping surfaces of the claw blocks of the cylinders becomes smaller by a predetermined constant angle for the cylinder closer to the printing impression cylinder away from the treatment section, smooth transferring of sheets can lie made equally for any of the adjacent cylinders.

With the arrangement in which lie inclined angle of the inclined surface of the claw block of the printing impression cylinder is set at 0°, it is possible to suppress deterioration of the registration accuracy for the impression cylinder, and thus carry out printing as in a conventional manner without troubles.

BRIEF DESCRIPTION OF THE DRAWINGS

The above, and other objects, features and advantages of the present invention will become apparent from the detailed description thereof in conjunction with the accompanying drawings wherein.

DESCRIPTION OF THE REFERENCE CODES

1: Sheet supply section, 2: Sheet of paper, 3: Printing section, 4: Varnishing section, 4A: Varnishing cylinder, 4BS Impression cylinder, 4BS: Outline, 5: Transfer film, 6: Surface processing section (treatment section), 7: Sheet discharge section, 7A, 7B: Sprockets, 7C: Chain, 8-12: Printing units, 8A-12A, 8B-12B, 18,19, 30A, 30B: Cylinders, 13, 15, 16, 17, 23: Grippers, 12S, 14S, 18S, 19S: Outlines, 13A, 15A, 16A, 17A, 23A: Claw blocks, 13B, 15B, 16B, 17B, 23B: Claws, 15H, 17H , 23H: Gripping surfaces, 15*a*, 16*a*, 17*a*, 23*a:* Gripping surfaces (Inclined surfaces), 20: Film transfer mechanism (Treatment, means), 21, 22: UV lamps, 23*b:* Outer circumferential side edge, 24: Substrate film (sheet material), 25: Roll, 26, 27: Pressing rollers, 28: Roll, α7-α4: Angles.

DETAILED DESCRIPTION OF THE PREFERRED EMBODIMENT

Figure 1:
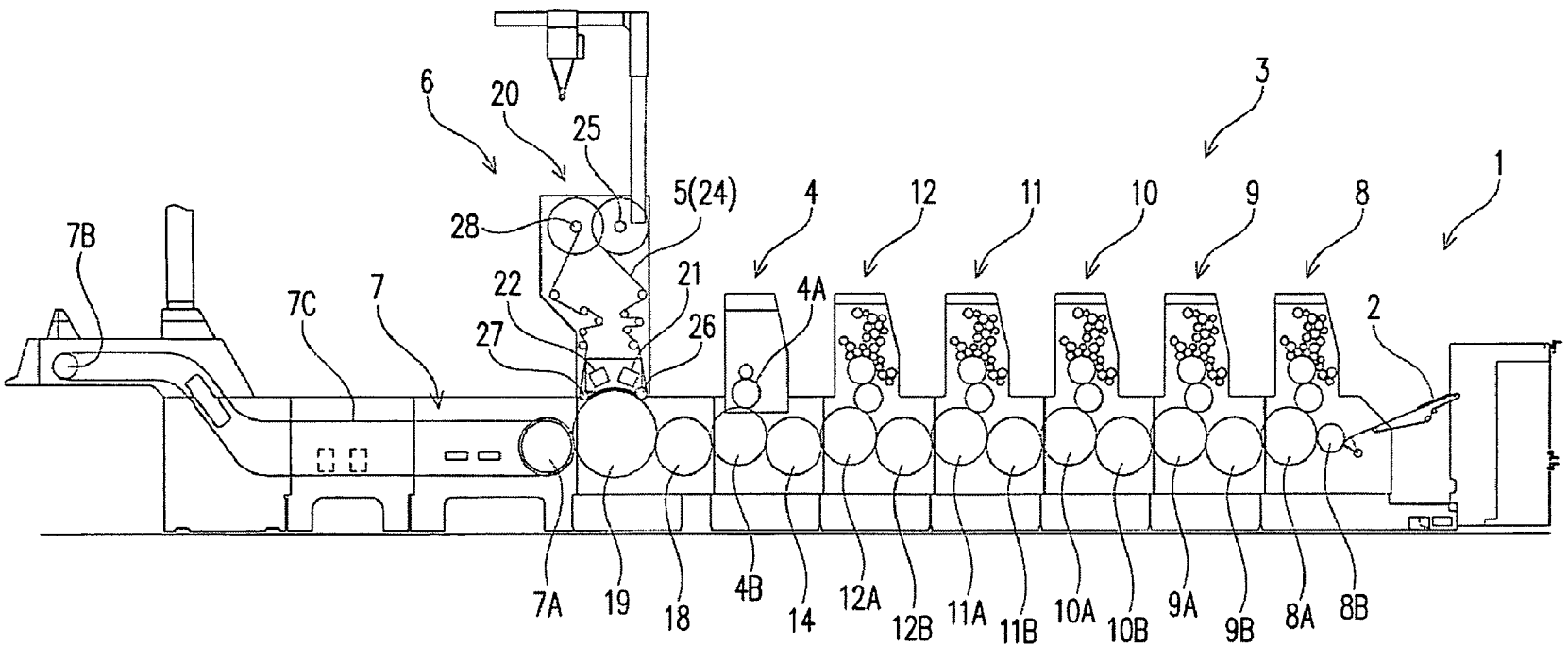
FIG. 1 is a schematic side view of a sheet-fed printing press.

FIG. 1 illustrates one example of a sheet-fed printing press that is capable of processing a printed surface of each printed sheet by applying resin varnish on the printed surface, thereby giving glossy finish to the printed surface, and then transferring gold foil, embossed pattern, hologram pattern or the like further onto the printed surface. This sheet-fed printing press includes a sheet supply section 1 for feeding sheets 2 one by one from a sheet stack table by a feeder or a sheet separator, a printing section 3 for printing in five colors on each sheet 2 fed from the sheet supply section 1, a varnishing section 4 for applying or coating UV cure resin varnish on each sheet 2 printed at the printing section 3, a surface processing section 6 as a treatment section for surface processing of each sheet 2 by pressing a transfer film 5 onto the UV cure resin varnish applied on the sheet 2 at the varnishing section 4, and a sheet discharge section 7 for discharging each sheet 2 having its surface treated by the surface processing section 6. In this embodiment, the printing section 3 is made up of five printing units 8, 9, 10, 11 and 12 for 5-color printing, while on the other hand, it is possible to employ a printing section that is designed for single color printing or two or more color printing other than five color printing. The sheet discharge section 7 is made up of a chain conveyor having grippers in this embodiment, while it is possible to employ a sheet-fed printing press that does not have the sheet discharge section 7. Also, it is to be noted that the specific structures of the respective elements or parts of the sheet-fed printing press are not limited to those illustrated in the drawings.

Figure 2:
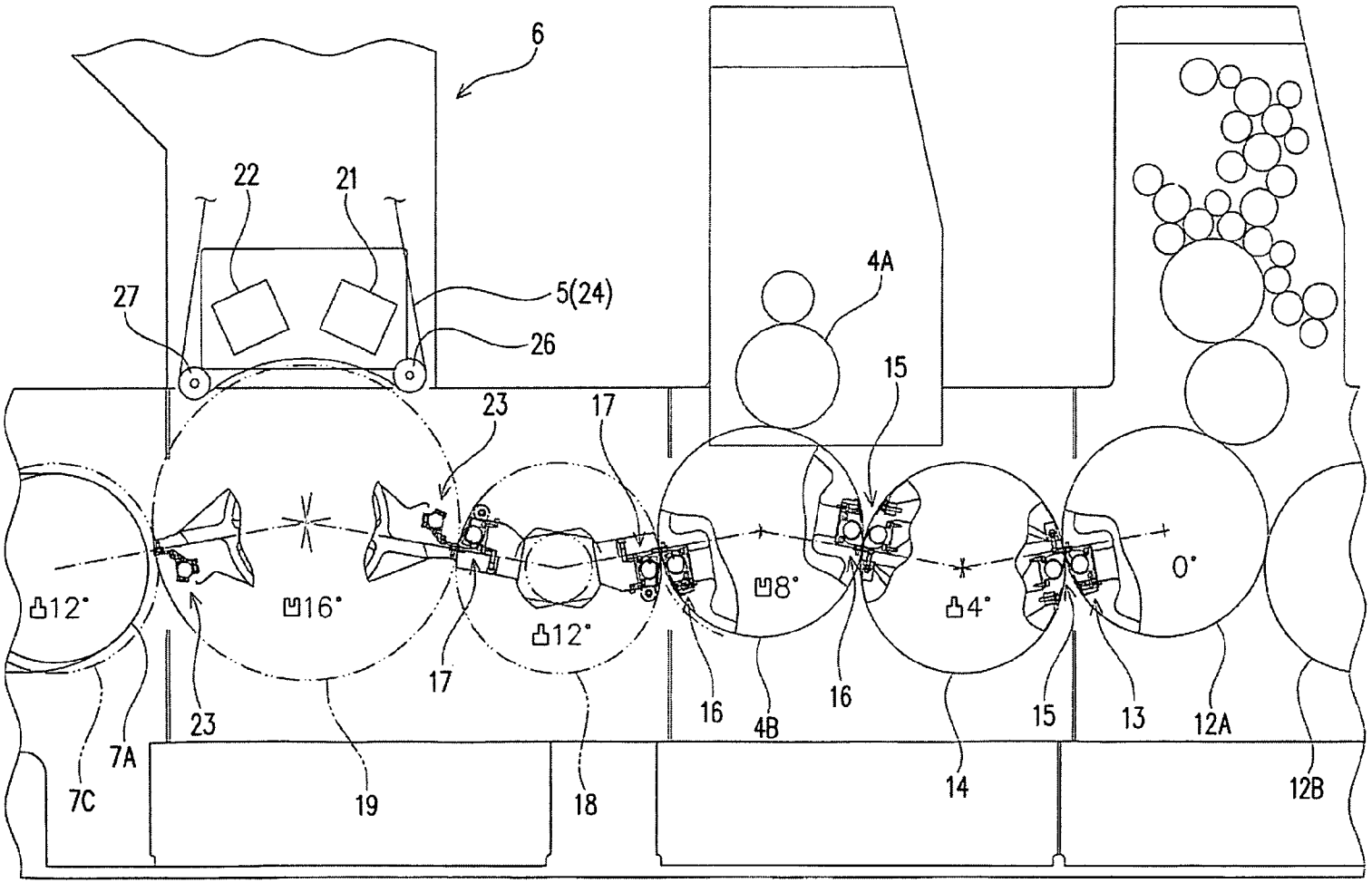
FIG. 2 is a side view of an essential portion extending from a treatment section to a printing impression cylinder.

The printing units 8-12 respectively include printing impression cylinders 8A-12A and transfer cylinders 8B-12B disposed respectively upstream of these printing impression cylinders 8A-12A in the sheet conveying direction for transferring the sheets 2 to the corresponding printing impression cylinders. The transfer cylinder 8B of the transfer cylinders 8B-12B, which is disposed at the most upstream position in the sheet conveying direction, is also referred as a sheet supply cylinder, and this transfer cylinder 8B together with, for example, a feeder and a sheet separator, constitute the sheet supply section 1. As illustrated in FIGS. 2-6, the cylinders 8A-12A and the transfer cylinders 9B-12B each have grippers 13 that are disposed at two positions (alternatively, it is possible to dispose one gripper or three or more grippers for each cylinder, although two grippers are illustrated in FIG. 2) on the circumference, in which each gripper 13 has a claw block 13A and a claw 13B that together grip each sheet 2 fed out. Although not illustrated, the transfer cylinder 8B having a smaller diameter has one gripper that is disposed at one position on the circumference for gripping each sheet 2 by a claw block and a claw. The varnishing section 4 includes a varnishing cylinder 4A to which UV cure resin varnish is supplied, and an impression cylinder 4B disposed opposite to the varnishing cylinder 4A for applying UV cure resin varnish on each printed sheet 2.

Also, the varnishing section 4 includes a transfer cylinder 14 for transferring each sheet 2 to the impression cylinder 4B. Both the cylinders 14 and 4B respectively have grippers 15, 16 disposed at two positions (alternatively, it, is possible to dispose one gripper or three or more grippers for each cylinder) on the circumference for gripping each oncoming sheet 2 by claw blocks 15A, 16A and claws 15B, 16B.

As illustrated in FIGS. 1 and 2, the surface processing section 6 includes an impression cylinder 19 for receiving each sheet 2 from a transfer cylinder 18 disposed for transferring each sheet 2 from the cylinder 4B, and a film transfer mechanism 20 for pressing and transferring the transfer film 5 onto each sheet 2 on the impression cylinder 19. The film transfer mechanism 20 corresponds to a treatment means for treatment of the sheets 2, and this film transfer mechanism 20 is designed to press and transfer the transfer film 5 onto each sheet 2, thereby transferring gold foil, embossed pattern, hologram pattern or the like onto each sheet 2 from the transfer film 5 while at the same time utilizing as adhesive UV cure resin varnish applied at the varnishing section 4. The surface of the sheet 2 on which UV cure resin varnish has been applied can be smoothened by pressing the transfer film 5 onto the UV cure resin varnish of each sheet 2 and thus the glossiness can he enhanced. Then, the UV cure resin varnish is cured by radiating UV rays from the UV lamps 21, 22 (alternatively, one UV lamp, or three or more UV lamps may be employed) from above the transfer film 5, which is being pressed on the sheet 2. The transfer cylinder 18 and the impression cylinder 19 also have grippers 17, 23 disposed at two position (alternatively, one gripper or three or more grippers may be disposed on each cylinder) on the circumference of each cylinder for gripping the sheets 2.

The sheets 2 conveyed while they are kept gripped by the grippers 13, 15 provided on the transfer cylinders 9B-12B and 14 are transferred to the grippers 13, 16 provided on the cylinders 8A-12A and 14B that are drivingly rotated at the same speed, and then the sheets 2 continuously conveyed. Specifically, as illustrated in FIG. 2, the sheets 2 are continuously conveyed while being gripped by the grippers 13, 16 through the operation, in which the grippers 13, 15 on the transferring side disposed at the same circumferential positions so as to be located opposite to the grippers 13, 16 on the receiving side are released from their gripping state, and at the same time the grippers 13, 16 on the receiving side are shifted from their opening state to the gripping state. The impression cylinder 19 is a so-called triple diameter cylinder having a diameter larger than the transfer cylinder 18, and has the grippers 23 at three positions on the circumference (in FIG. 2, only the two grippers are illustrated while omitting the residual one gripper). Accordingly, the transfer cylinder 18 rotates one-half turn for every one turn of the impression cylinder 19, so that each sheet 2 can be transferred from the gripper 17 of the transfer cylinder 18 to the gripper 23 of the impression cylinder 19 in the manner as mentioned above. The impression cylinder 19 having a diameter larger than the other cylinders (triple-diameter cylinder) can not only secure a greater drying zone, through which UV radiation is made, but also produce an advantage of providing a greater distance relative to the varnishing section 4, although the impression cylinder 19 may have the same diameter as the diameter of the other cylinders.

When gold foil is adhered onto the printed surface, a foil stamping device called as foiler is used to press a printed matter onto the gold foil, thereby allowing the gold foil to be released from a substrate and adhered onto a portion of the printed matter with glue or varnish applied thereon. As the treatment section, the surface processing section 6 for transferring gold foil, embossed pattern, hologram pattern or the like onto a printed surface is illustrated, while it is possible to employ various kinds of treatment section. For example, when especially a film is used as a print matter, a treatment section may be designed to perform corona discharge to allow the print matter to take ink well. For enhancing the effect of corona discharging, a corona discharging body for discharging corona is located to the surface of a print matter as close as possible when corona discharge is made. Accordingly, when a gripper projects through the surface of a cylinder, the gripper may contact the corona discharging body. In order to prevent this, the gripper is designed not to project through the surface of the cylinder, as described below, while it is possible to allow the gripper to slightly project through the surface of the cylinder, as long as it projects to such an extent as not to contact the treatment means. Furthermore, a perforation forming device for forming perforations on a print matter may be provided. This perforation forming device is comprised of a perforation forming impression cylinder, and vertical and transverse perforation blades disposed to be able to come into contact with the perforation forming impression cylinder, thereby forming vertical and transverse perforations. A slitter device for cutting a print matter may be provided. This slitter device is designed to be able to cut or perforate each printed matter (or an unprinted sheet), which has been conveyed by a slitter cylinder, by a slitter having an circular plate shape and disposed above the slitter cylinder. Furthermore, a folding device for forming a told line on a print matter may be employed, which has a folding cutter that can form a fold line.

Figure 3:
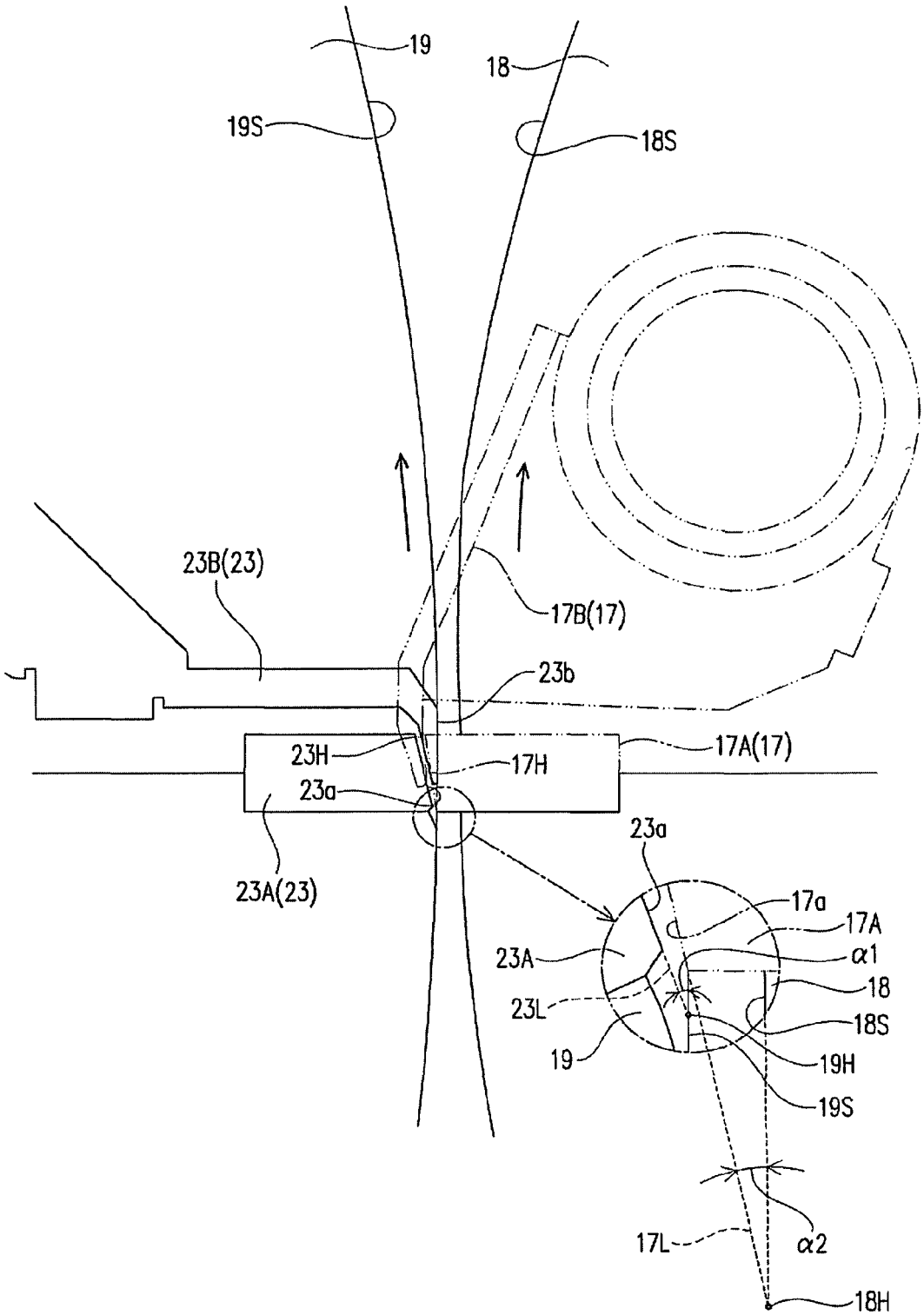
FIG. 3 is an enlarged schematic view illustrating a sheet transferring area between a gripper of a cylinder of the treatment section and a gripper of a transfer cylinder disposed upstream of and adjacent to the treatment section in the sheet conveying direction.
Figure 4:
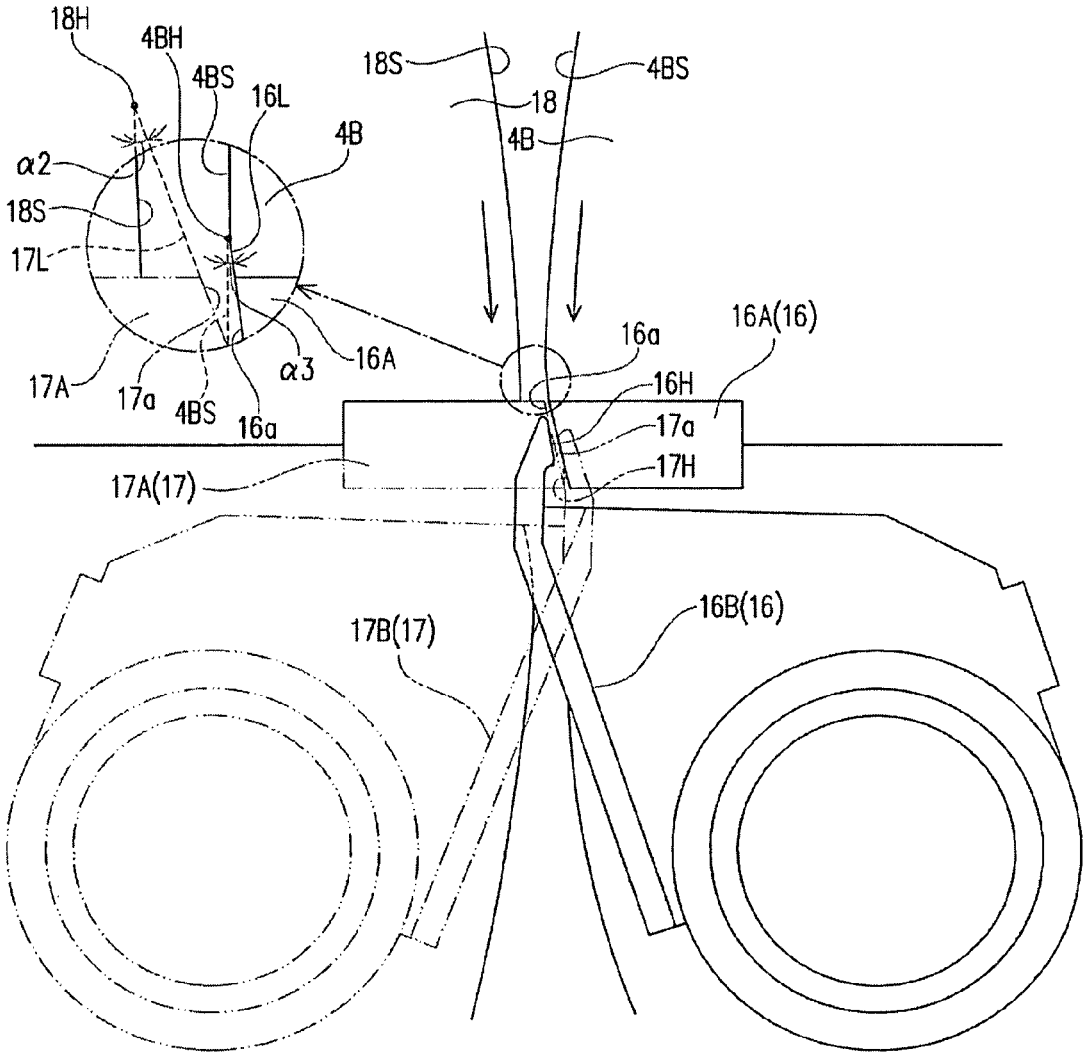
FIG. 4 is an enlarged schematic view illustrating a sheet transferring area between a gripper of a varnishing cylinder and a gripper of a transfer cylinder disposed downstream of and adjacent to the varnishing cylinder.
Figure 5:
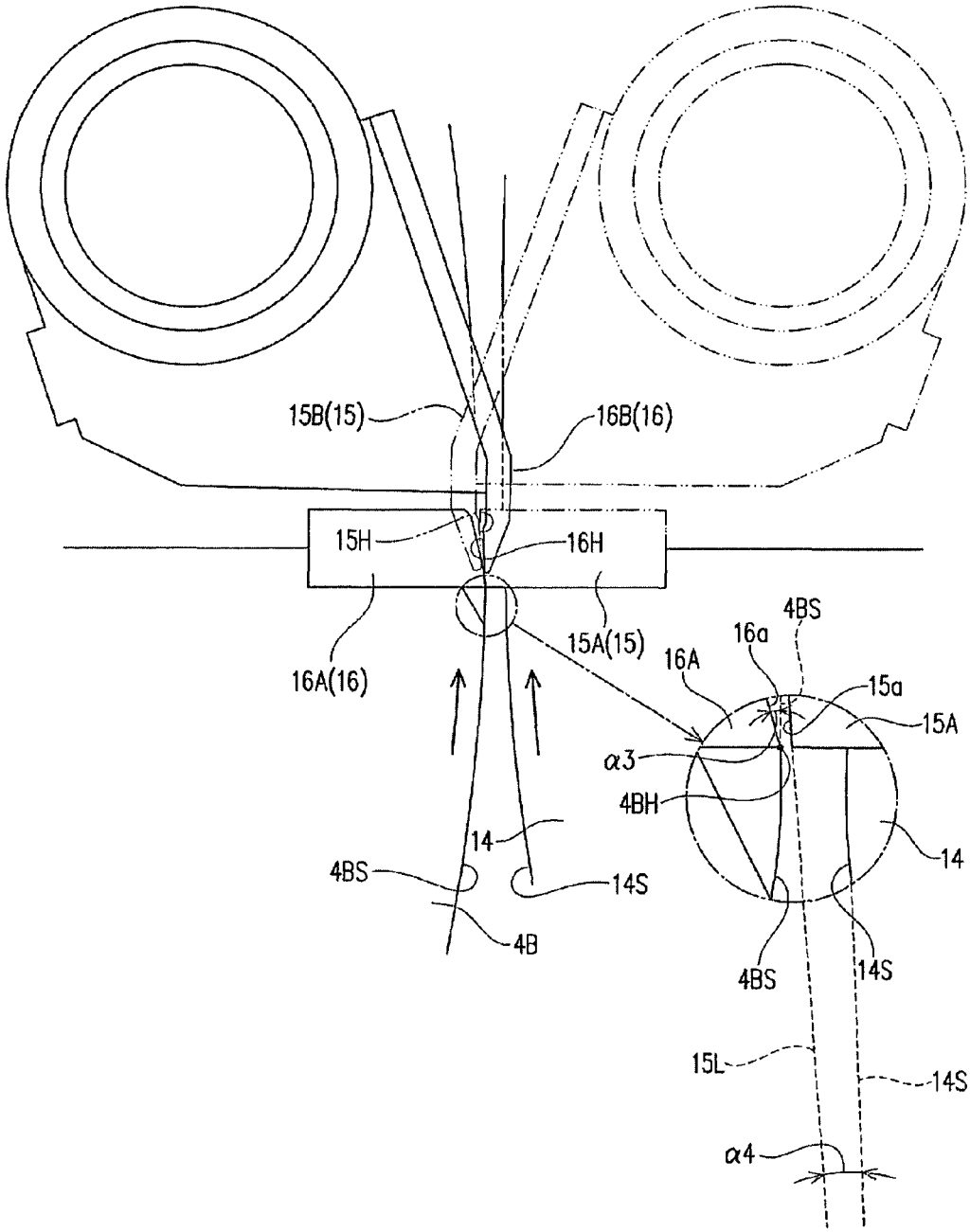
FIG. 5 is an enlarged schematic view illustrating a sheet transferring area between a gripper of a varnishing cylinder and a gripper of a transfer cylinder disposed upstream of and adjacent to the varnishing cylinder.
Figure 6:
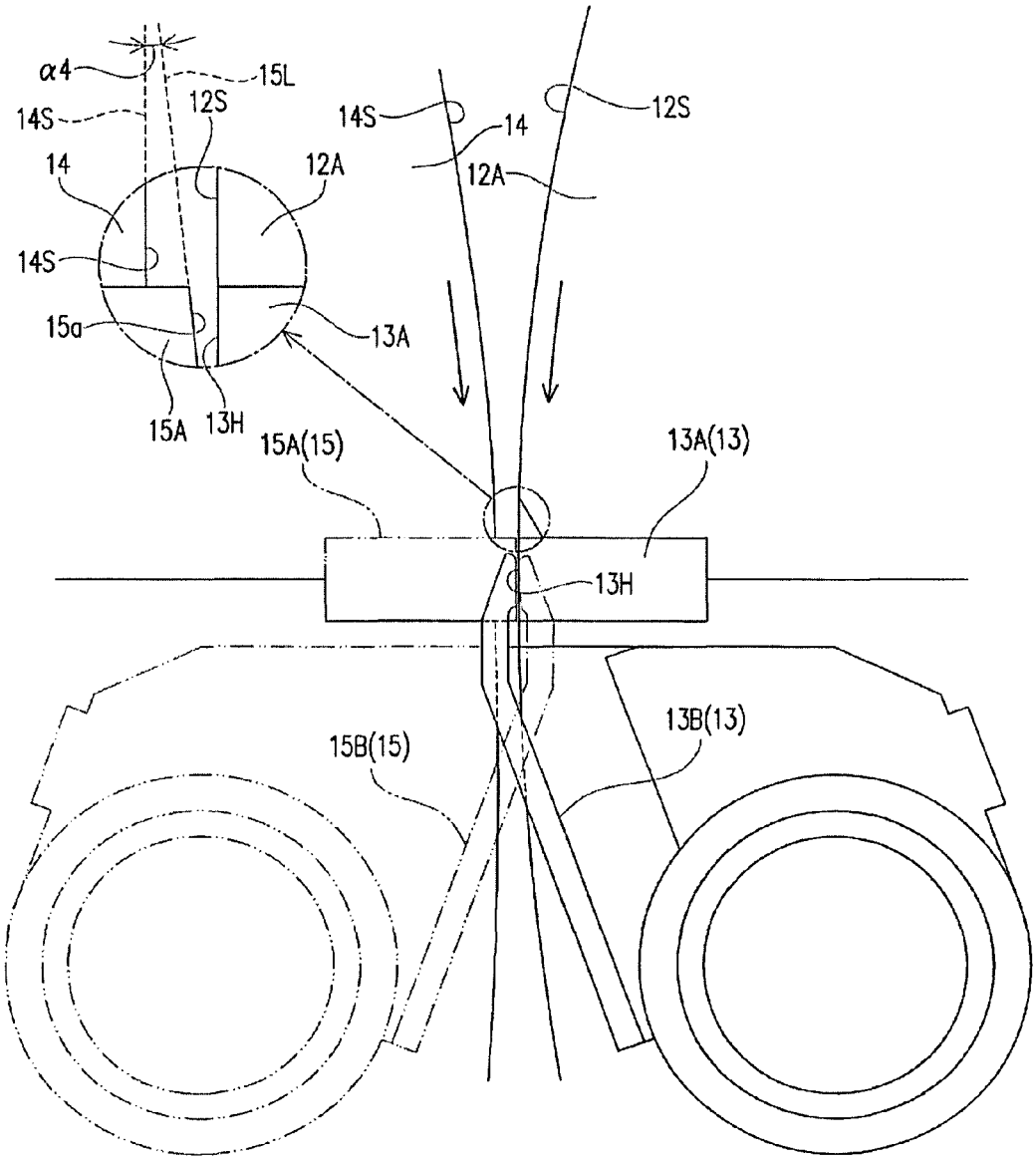
FIG. 6 is an enlarged schematic view illustrating a sheet transferring area between a gripper of a printing impression cylinder and a gripper of a transfer cylinder disposed downstream of and adjacent to the printing impression cylinder.

FIG. 3 illustrates an impression cylinder 19 of the surface processing section 6 and a transfer cylinder disposed upstream of and adjacent to the impression cylinder 19. FIG. 4 illustrates the transfer cylinder 18, and a cylinder 4B for varnish application disposed upstream of and adjacent to the transfer cylinder 18. FIG. 5 illustrates the transfer cylinder 4B and a transfer cylinder 14 disposed upstream of and adjacent to the cylinder 4B. FIG. 6 illustrates the transfer cylinder 14 and an impression cylinder 12 disposed upstream of and adjacent to the transfer cylinder 14. The description will be made hereinafter for grippers mounted to these cylinders.

First, as illustrated in FIG. 3, a gripping surface 23*a* of a claw block 23A of a gripper 23 mounted to the impression cylinder 19 is formed into an inclined flat surface that comes closer to the rotational axis (inside of the impression cylinder 19) as it advances downstream in the sheet conveying direction of the impression cylinder 19, and an inclined angle $\alpha$1 of the inclined surface 23*a* is set at an angle (herein 16°), at which a claw 23B of the gripper 23 mounted to the impression cylinder 19 does not project through an outline 19S of the impression cylinder 19, while it is possible to set it at any angle as long as the claw 23B does not project through the outline 19S of the impression cylinder 19. However, when the treatment means has a structure allowing itself to be kept out of contact, with the impression cylinder 19 during operation, for example, for corona discharging, the claw 23B may project through the outline 19S of the impression cylinder 19. By the expression "the claw 23B does not project through the outline 19S of the impression cylinder 19", it is meant herein that an end 23*b* of the claw 23B close to the circumferential surface of the impression cylinder 19 is flush with the circumferential surface of the impression cylinder 19 (as illustrated in FIG. 3), and that the end 23*b* of the claw 23B close to the circumferential surface of the impression cylinder 19 is located inside of the circumferential surface of the impression cylinder 19. Of them, the flushing arrangement is more preferable. A gripping surface 23H of the claw 23B against the claw block 23A is formed into an inclined surface to be substantially in parallel with the gripping surface 23*a* of the claw block 23A, so that, there is an advantage in that a sheet can be gripped through an increased area along the sheet conveying direction, although the gripping surface 23H may be formed into a curved surface according to needs and circumstances.

The inclined angle α1 is, for example, an angle determined by an extension 23L, (illustrated by the broken line) of the gripping surface 23*a* of the claw block 23A and a tangent 19S at an intersection 19H at which the extension 23L intersects the outline 19S of the impression cylinder 19S, as illustrated in, for example, FIG. 3. Herein, the outline 19S appears to extend substantially straight through a small area since the impression cylinder 19 has a large diameter and the claw block 23A is small as compared with the impression cylinder 19. Accordingly, even when a tangent is drawn to the outline 19S at the intersection 191H, it becomes substantially the same line as the outline 19S, and therefore the outline 19S is herein explained as a tangent. Since this fact is also applicable in all the claw blocks, the explanation on this will be hereinafter omitted. The inclined angle α1 becomes necessarily smaller as the downstream end of the gripping surface 23*a* of the claw block 23A in the sheet conveying direction of the impression cylinder 19 is positioned closer to the outline 19S of the impression cylinder 19, while the inclined angle α1 becomes necessarily greater as the downstream end is positioned farther away from the outline 19S. This is also applicable to all the claw blocks.

According to the aforesaid arrangement, in which the gripping surface 23*a* of the claw block 23A of the impression cylinder 19 does not project through the outline 19S of the impression cylinder 19, the transferring positions of both the grippers 23, 17 are matched by projecting a gripping surface 17*a* of a claw block 17A of a gripper 17 of the transfer cylinder 18 disposed on the transferring side (upstream side of the conveying direction) from the outline 18S of the transfer cylinder 18. In other words, the transferring positions are matched by reversing the projection relationship between the gripper 17 of the transfer cylinder 18 and the gripper 23 of the impression cylinder 19. Specifically, the claw block 17A of the gripper 17 is positioned to project outwards through an outline 18S of the transfer cylinder 18, and a gripping surface 17*a* of the claw block 17A is formed into an inclined flat surface that projects further through the outline 18S of the transfer cylinder 18 as it advances downstream in the sheet conveying direction of the impression cylinder 19. An inclined angle α2 of the projecting inclined surface 17*a* (illustrated also in FIG. 4) is set at an angle of 12°, which is smaller than the aforesaid 16°, thereby causing an angular difference of 4° therebetween and hence preventing great change in gripping angles between the grippers at the time of transferring each sheet 2. The inclined angle α2 is also an angle determined by an extension 17L (illustrated by the broken line) of the gripping surface 17*a* of the claw block 17A and a tangent 18S at an intersection 18H at which the extension 17L intersects the outline 18S of the transfer cylinder 18, in the same manner as the inclined angle α1.

With the above arrangement, sheets can be securely and smoothly transferred from the transfer cylinder 18 to the impression cylinder 19 without causing creases or wrinkles in sheets. The projecting amount of the claw block 17A of the gripper 17 of the transfer cylinder 18, which projects outward through the transfer cylinder 18, is set to prevent the sheet gripping position of the gripper 23 of the impression cylinder from greatly differing in a sheet thickness direction from the sheet gripping position of the gripper 17 of the transfer cylinder 18. A gripping surface 17H of the claw 17B against the claw block 17A is also formed into an inclined surface to be substantially in parallel with the gripping surface 17*a* of the claw block 17A, so that there is an advantage in that each sheet can be gripped through an increased area along the sheet conveying direction, although the gripping surface 17H may be formed into a curved surface according to needs and circumstances. Although substantially the entire area of the upper surface of each of the claw blocks 23A and 17A is formed into an inclined surface for sheet gripping, it is possible to have only a partial area of the upper surface formed into an inclined surface for sheet gripping.

As illustrated in FIG. 4, the gripping surface 17*a* of the claw block 17A of the gripper 17 of the transfer cylinder 18 is positioned to project through the outline 18S of the transfer cylinder 18, so that the gripping surface 16*a* of the claw block 16A of the gripper 16 of the impression cylinder 4B disposed on the transferring side (upstream of and adjacent to the transfer cylinder 18) does not protrude from the outline 4BS of the impression cylinder 4B. Whereby, the transferring positions of both the grippers 17, 18 in the sheet thickness direction are matched. In this case, the gripping surface 16*a* of the claw block 16A of the gripper 16 is formed into an inclined flat surface that comes closer to the rotational axis as it advances downstream in the sheet conveying direction of the impression cylinder 4B. Furthermore, an inclined angle α3 of the inclined surface 16*a* is set at an angle of 8°, which is smaller than the aforesaid angle α2 (12°), thereby causing an angular difference of 4° therebetween and hence preventing great change in gripping angles at the time of transferring each sheet 2. Thus, sheets can be securely and smoothly transferred between the cylinders without causing creases or wrinkles in sheets. The inclined angle α3 is also an angle determined by an extension 16L, (illustrated by the broken line) of the gripping surface 16*a* of the claw block 16A and a tangent 4BS at an intersection 4BH at which the extension 16L intersects the outline 4BS of the impression cylinder 4B. A gripping surface 16H of the claw 16B against the claw block 16A is also formed into an inclined surface to be substantially in parallel with the gripping surface 16*a* of the claw block 16A, so that there is an advantage in that each sheet can be gripped through an increased area along the sheet conveying direction, although the gripping surface 16H may be formed into a curved surface according to needs and circumstances. Although substantially the entire area of the upper surface of the claw block 16A is formed into an inclined surface for sheet gripping, it is possible to have only a partial area of the upper surface formed into an inclined surface for sheet gripping.

As illustrated in FIG. 5, the gripping surface 16*a* of the claw block 16A of the gripper 16 of the impression cylinder 4B is positioned not to protrude from the outline 4BS of the impression cylinder 4B, so that the gripping surface 15a of the claw block 15A of the gripper 15 of the transfer cylinder 14 disposed on the transferring side (upstream of and adjacent to the impression cylinder 4B) protrudes from the outline 14S of the transfer cylinder 14. Whereby, the transferring positions of both the grippers 16, 15 in the sheet thickness direction are matched. In the same manner as those of the transfer cylinder 18, for the transfer cylinder 14, the gripping surface 15*a* of the claw block 15A of the gripper 15 is formed into an inclined flat surface that projects further through the outline of the transfer cylinder 14 as it advances downstream in the sheet conveying direction of the impression cylinder 4B. An inclined angle α4 of the inclined surface 15*a* is set at an angle of 4°, which is smaller than the aforesaid α3(8°), thereby causing an angular difference of 4° therebetween and hence preventing great change in gripping angles between the grippers at the time of transferring each sheet 2. With this arrangement, sheets can be securely and smoothly transferred from the transfer cylinder 18 without causing creases or wrinkles in sheets. The inclined angle α4 is also an angle determined by an extension 15L (illustrated by the broken line) of the gripping surface 15*a* of the claw block 15A and a tangent 14S (illustrated by the broken line) at an intersection (not illustrated in FIGS. 5 and 6, since the angle is small) at which the extension 15L intersects the outline 14S of the transfer cylinder 14, in the same manner as above. A gripping surface 15H of the claw 15B against the claw block 15A is formed into an inclined surface to be substantially in parallel with the gripping surface 15*a* of the claw block 15A, so that there is an advantage in that a sheet can be gripped through an increased area along the sheet conveying direction, although the gripping surface 15H may be formed into a curved surface according to needs and circumstances. Although substantially the entire area of the upper surface of the claw block 15A is formed into an inclined surface for sheet gripping, it is possible to have only a partial area of the upper surface may be formed into an inclined surface for sheet gripping.

As illustrated in FIG. 6, the gripping surface 15*a* of the claw block 15A of the gripper 15 of the transfer cylinder 14 is positioned to project through the outline 14S of the transfer cylinder 14. However, the sheet gripping position of the gripper 13 of the impression cylinder 12A disposed on the transferring side (upstream of and adjacent to the transfer cylinder 14) does not cause the transferring position of the gripper 13 from being greatly out of alignment with the transferring position of the gripper 15 in the sheet thickness direction, since the inclined angle is set at a small angle, namely 4°.

In order to increase the registration accuracy, the claw block 13A of the gripper 13 of the impression cylinder 12A does not have an inclined surface unlike the above arrangement, and therefore an angle determined by the gripping surface 13H or the claw block 13A and the outline 12S of the impression cylinder 12A becomes 0°. That is, the claw block 13A is formed into a flat surface substantially conforming to or substantially in flush with a tangent of the outline 12S of the impression cylinder 12A, in which the tangent practically becomes identical to the outline 12S since the outline 12S extends substantially straight. However, when the angle is 4° or smaller, the registration accuracy is unlikely to be greatly deteriorated, and therefore the gripper 13 can have a small inclined surface in actual use. For the grippers of the respective cylinders (12B-8B) disposed upstream of the impression cylinder 12A, an angle determined by the gripping surface of a claw block and the outline of an impression cylinder is 0°, in the same manner as the impression cylinder 12A. Therefore, it is possible to perform printing while ensuring high registration accuracy.

The above embodiment was described by taking, for example, the case in which the inclined angle of the claw blocks is changed by a constant angle or 4° for the cylinders from the transfer cylinder 14 downstream of and adjacent to the printing impression cylinder 12A to the impression cylinder 19 of the treatment section. In this respect, it is possible that the inclined angle is changed by a varying angle. In this embodiment, three cylinders are disposed between the transfer cylinder 14 and the impression cylinder 19 of the treatment section. This is not essential, while it is possible to dispose two or four or more cylinders.

With the above arrangement, in which the grippers 23 of the impression cylinder 19 are located inside the impression cylinder 19, it is possible to prevent the transfer film 5 from contacting the grippers 23 and hence being damaged. Also, with the arrangement, in which the inclined angle of the gripping surface of each claw block is set to be smaller for the cylinder closer to the printing impression cylinder 12A, it is possible to minimize the positional difference in the thickness direction of the sheets 2 between the gripping position of the gripper 13 of the printing impression cylinder 12A having an inclined angle of 0° and the gripping position of the gripper 15 of the transfer cylinder 14.

Figure 8A:
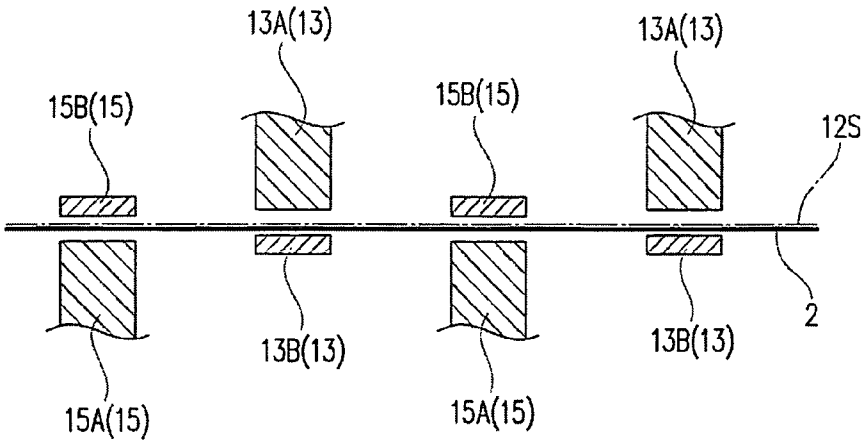
FIG. 8 are schematic front views of the grippers respectively when in sheet transferring, in which FIG. 8(*a*) illustrates the gripper of the present invention, and FIG. 8(*b*) illustrates the gripper of a comparative example.
Figure 8B:
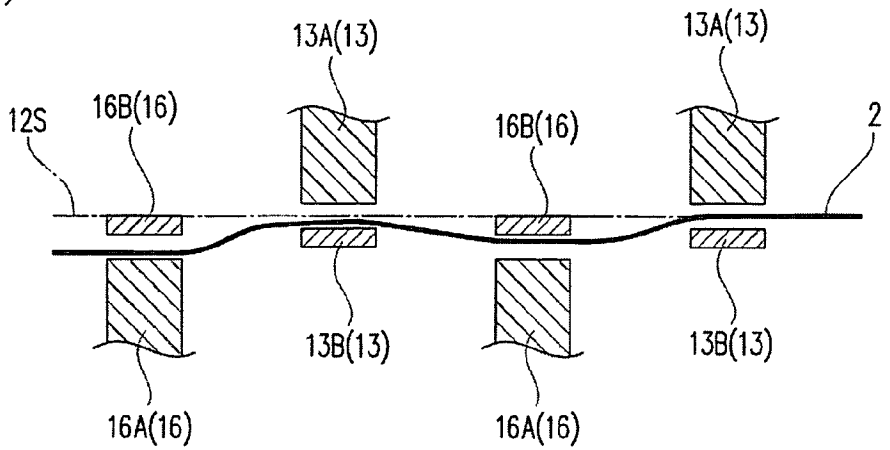

Examples of the transferring operation between the adjacent grippers are illustrated in FIGS. 8(*a*) and 8(*b*), in which FIG. 8(*a*) is a cross section illustrating a transferring operation between the gripper 13 of the impression cylinder 12A and the gripper 15 of the transfer cylinder 14, and FIG. 8(*b*) is a cross section illustrating a transferring operation between not the transfer cylinder 14 but the gripper 16 of the impression cylinder 4B having a large inclined angle (8°) and the gripper 13 of the impression cylinder 12A. In FIG. 8(*b*), the gripper 16 of the impression cylinder 4B having a large inclined angle (8°) causes the gripping position of the gripper 16 of the impression cylinder 4B, at, which each sheet is gripped, to be greatly out of alignment with the outline 12S of the impression cylinder 12B in the sheet widthwise direction (In FIG. 8(*b*), the gripping position is located downward away from the aligned position, but is located actually away from the aligned position towards the impression cylinder 4B), and therefore the sheet 2 cannot be gripped at the aligned position in the thickness direction. This transferring operation may cause damage or deformation of the sheet 2, but by the arrangement of the present invention with omitting the angular difference between the adjacent gripper blocks, the sheet can be transferred substantially at the same position so that the sheet 2 can be smoothly transferred without causing damage or deformation. Specifically, as illustrated in FIG. 2, for the impression cylinder 19 of the treatment section 6, the inclined angle is set at 16° (referred as recess: 16° in FIG. 2) so as not to project from the impression cylinder 19; the claw block 17A of the gripper 17 of the transfer cylinder 18 upstream of and adjacent to the impression cylinder 19 is inclined at 12° (referred as projection: 129 in FIG. 2) thus projecting outwards, while the inclined angle for the impression cylinder 4B upstream of and adjacent to the transfer cylinder 18 is 8° (referred as recess: 8° in FIG. 2) thus having the gripper located inside the impression cylinder 4B; and the inclined angle of the claw block 15A of the gripper 15 of the transfer cylinder 14 upstream of and adjacent to the impression cylinder 4B is 4° (referred as projection: 4°) thus having the gripper projecting outwards. Thus, the inclined angle becomes smaller by a constant angle for the cylinder closer to the impression cylinder 12A. The smaller the constantly reduced inclined angle is, the better the effectiveness is, while it is possible to employ any angle.

As illustrated in FIG. 1, the film transfer mechanism 20 is disposed above the downstream impression cylinder 19, and includes an elongated substrate film 24 for film transferring with a large number of transfer films 5 successively or intermittently with given distance aligned on a surface of the substrate film 24, a feed roll 25 for winding up the substrate film 24 and feeding the same, a pair of pressing rollers 26, 27 for pressing the substrate film 24 fed from the feed roll 25 and thereby attaching the same onto the sheet 2 on the downstream impression cylinder 19, and a winding roll 28 for winding up thereon the substrate film 24 while pulling upward the same away from the downstream pressing roller 27, thereby transferring each transfer film 5 onto each sheet 2. Herein, two pressing rollers 26, 27 are disposed while it is possible to employ three or more pressing rollers, or one pressing roller according to needs and circumstances. The substrate film 24 may be formed by a resin sheet material having a minute irregular surface, in which this substrate film 24 is pressed onto varnish applied on an upper surface of the sheet 2 and thereby a line irregular surface of, such as embossed pattern, hologram pattern or the like, is formed on the surface of the varnish. In this case, the sheet material or substrate film can be repeatedly used until it is deformed by the UV radiation.

The grippers 13 each include plural claw blocks secured to a holder having an elongated lateral axis, and plural (the same number as that of the claw blocks) claws rotatably mounted to a rotational shaft extending through the holder and supported by the same and urged by a spring (not illustrated) towards the claw blocks so as to grip an oncoming sheets positioned at upper ends of the claw blocks. It is to be noted that FIGS. 3 and 4 each illustrate only a single claw.

The sheet discharge section 7 is provided with a conveyor that receives an oncoming sheet 2 treated at the treatment section and conveyed thereto, and conveying the same to a predetermined position. This conveyor includes a pair of endless chains 7C as endless running members wound around a pair of sprockets 7A, 7B disposed respectively at the opposite terminal ends of the conveying path of the conveyor and on each of the opposite lateral sides with the conveying path therebetween, and grippers (not illustrated) having substantially the same structure as that of the aforesaid grippers and mounted to each chain, in which each claw block has an inclined surface of 12° to project through an outline of the sprocket 7A (referred as projection: 12° in FIG. 2).

Figure 7:
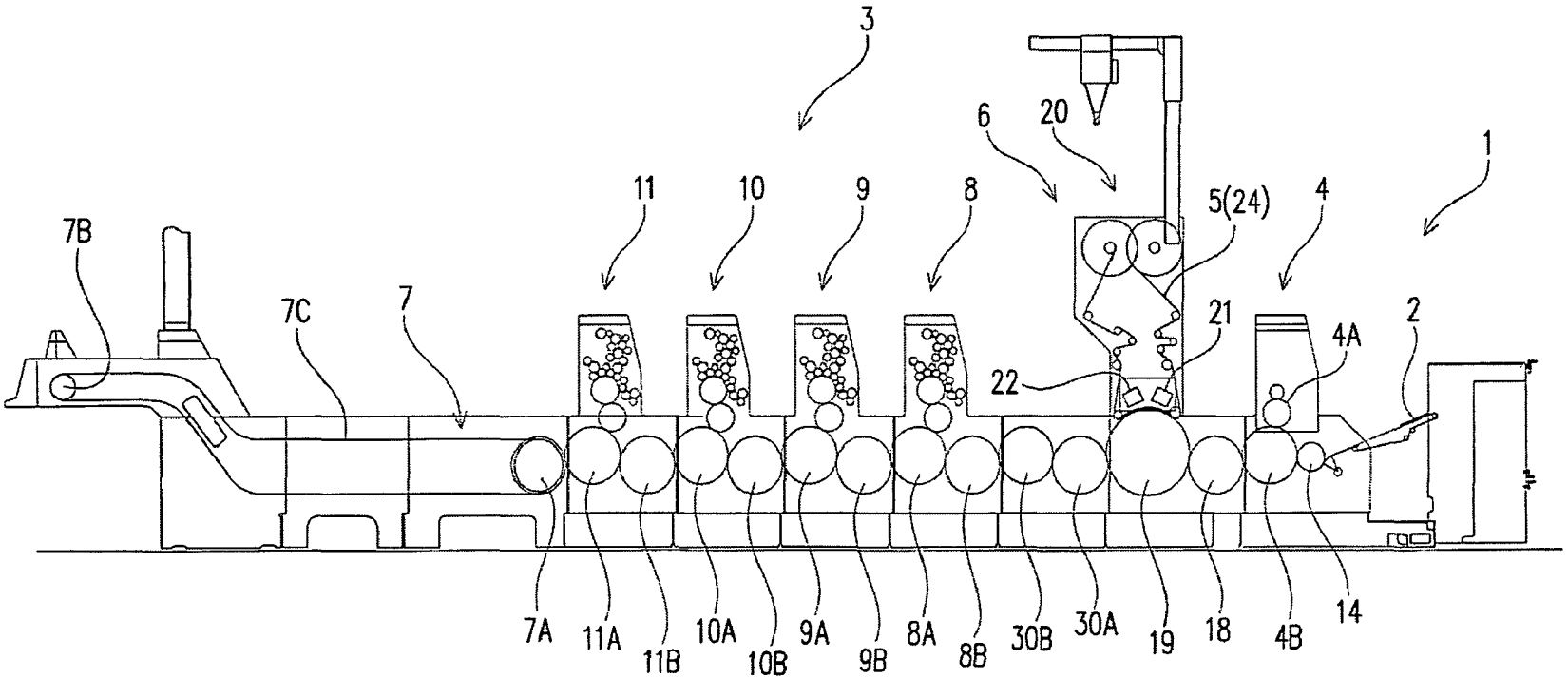
FIG. 7 is a schematic side view of a sheet-fed printing press, in which a treating section is installed forward of a printing section.

With reference to FIGS. 1-6, the description was made by taking, for example, the case in which the printing impression cylinder 12A is disposed upstream of the surface processing section 6. However, it is possible to dispose the printing impression cylinder 8B downstream of the treatment section 6, or dispose the treatment section 6 at a portion (between the sheet supply section and the printing section), at which sheets 2 have not yet been printed. In this case, three transfer cylinders 30A, 30B, 8B are disposed between the treatment section 6 and the printing impression cylinder 8A, and grippers are mounted at two portions (alternatively, it is possible to mount one gripper or three or more grippers for each cylinder) on the circumference of each cylinder, and the inclined angle of a claw block of each gripper is stepwisely decreased by a constant amount or a varying amount in the same manner as that mentioned above. The gripping surface of each claw block positioned in a path from the varnishing section 4 to the treatment section 6 illustrated in FIG. 7 may be formed with no inclined surface (with an inclined angle of 0°), or may be formed with an inclined surface. In FIG. 7, the printing section 3 has four printing units 8, 9, 10, 11 for four color printing. The portion illustrated in FIG. 7, for which the description was not made because the structure thereof is the same as that of FIG. 1, will be allocated the same reference codes as those of FIG. 1 to omit the description thereof.

31 In FIGS. 1-6, the gripping surface of each claw block is formed into an inclined surface and the inclined angle becomes greater for the cylinder closer to the treatment section 6 away from the printing impression cylinder 12A. This is not essential for the present invention, and it is possible to employ an arrangement in which the gripping surface of each claw block is not formed into an inclined surface, but formed into a surface extending substantially in parallel with the tangent of the outline of a corresponding cylinder, and these claw blocks are respectively located at such a position as to project from a corresponding cylinder and at such a position as to retract below the outline of a corresponding cylinder. Although not illustrated, the detailed description on this will be made provisionally with reference to FIG. 2. The grippers 23 of the cylinder 19 of the treatment section 6 are disposed at positions retracting from the outline of the cylinder 19. Of the plural cylinders 18, 4*b*, 14 disposed between the treatment section 6 and the printing impression cylinder 12A, (In FIG. 2, three cylinders are disposed, although two or four or more cylinders may be disposed. When an even number of cylinders are disposed, the transfer film 5 and the like of the treatment section 6 must be provided below the cylinder 19), a gripping surface of each of the claw blocks provided in the first cylinder 18 most adjacent to the treatment section 6 is located at a position projecting through the outline of the first cylinder 18; the gripping surface of each of the claw blocks provided in the second cylinder 4B upstream of and adjacent to the first cylinder 18 is located at a position retracting from the projecting position of each of the claw blocks provided in the first cylinder 18; the gripping surface of each of the claw blocks provided in the residual cylinder, which is disposed closest to the printing impression cylinder 12A, is located at a position projecting from this cylinder. Thus, the projecting or retracting amount of the gripping surface of each gripper may be greatly changed for the cylinder closer to the cylinder 19 of the surface processing section 6 away from the printing impression cylinder 12A. In summary, by setting the projecting or retracting amount of the inclined surface of each of the claw blocks provided in the cylinder 14 closest to the printing impression cylinder 12A to be smaller than the projecting or retracting amount of the inclined surface of each of the claw blocks provided in the residual cylinders, it is possible to produce advantages in that printing can be made with high registration accuracy; the sheet gripping positions of the adjacent grippers are not greatly misaligned from each other, thereby achieving smooth transferring of sheets between the adjacent cylinders without causing damages to sheets, or causing creases or wrinkles in sheets.

This specification is by no means intended to restrict the present invention to the preferred embodiments set forth therein. Various modifications to the sheet-fed printing press, as described herein, may be made by those skilled in the art without departing from the spirit and scope of the present invention as defined in the appended claims.

What is claimed is:

1. A sheet-fed printing press comprising a treatment section that includes a cylinder having a gripper for gripping each of oncoming sheets by a claw block and a claw, and a treatment means for treating said sheet in proximity to or in contact with the surface of said sheet conveyed downstream in a sheet conveying direction while being gripped by the gripper, and plural cylinders disposed between the treatment section and a printing impression cylinder disposed upstream of the treatment section in the sheet conveying direction, each cylinder including a gripper having the same structure as that of the gripper, wherein a gripping surface of the claw block provided in the cylinder of the treatment section is formed into an inclined surface that comes closer to the rotational axis as it advances downstream in the sheet conveying direction of the cylinder, so as not to have the gripper of the cylinder contacting the treatment means, a gripping surface of a claw block provided in a first cylinder of the plural cylinders, most adjacent to the treatment section, is formed into an inclined surface that projects further through an outline of the cylinder as it advances downstream in the sheet conveying direction, a gripping surface of a claw block provided in a second cylinder of the plural cylinders, upstream of and adjacent to the first cylinder of the plural cylinders, is formed into an inclined surface that comes closer to the rotational axis as it advances downstream in the sheet conveying direction of the cylinder, and a gripping surface of a claw block provided in a third cylinder of the plural cylinders, which is closest to the printing impression cylinder, is formed into an inclined surface inclined at an angle smaller than the inclined angle of the gripping surface of the claw block of the cylinder provided in the treatment section.

2. A sheet-fed printing press comprising a treatment section that includes a cylinder having a gripper for gripping each of oncoming sheets by a claw block and a claw, and a treatment means for treating said sheet in proximity to or in contact with the surface of said sheet conveyed while being gripped by the gripper to the downstream side in a sheet conveying direction, and plural cylinders disposed between the treatment section and a printing impression cylinder disposed downstream of the treatment section in the sheet conveying direction, each cylinder including a gripper having the same structure as that of said gripper, wherein a gripping surface of the claw block provided in the cylinder of the treatment section is formed into an inclined surface that conies closer to the rotational axis as it advances downstream in the sheet conveying direction of the cylinder, so as not to have the gripper of the cylinder contacting the treatment means, a gripping surface of a claw block provided in a first cylinder of the plural cylinders, most adjacent to the treatment section, is formed into an inclined surface that projects further through an outline of the cylinder as it advances downstream in the sheet conveying direction, a gripping surface of a claw block provided in a second cylinder of the plural cylinders, downstream of and adjacent to the first cylinder of the plural cylinders, is formed into an inclined surface that comes closer to the rotational axis as it advances downstream in the sheet conveying direction of said cylinder, and a gripping surface of a claw block provided in a third cylinder of the plural cylinders, which is closest to the printing impression cylinder is formed into an inclined surface inclined at an angle smaller than the inclined angle of the gripping surface of the claw block of the cylinder provided in the treatment section.

3. The sheet-fed printing press according to claim 1, wherein the inclined angle of each of the gripping surfaces of the claw blocks of the cylinders becomes smaller for the cylinder closer to the printing impression cylinder.

4. The sheet-fed printing press according to claim 1, wherein the inclined angle of each of the gripping surfaces of the claw blocks of the cylinders becomes smaller by a predetermined constant angle for the cylinder closer to the printing impression cylinder away from the treatment section.

5. The sheet-fed printing press according to claim 1, wherein the inclined angle of the inclined surface of the claw block of the printing impression cylinder is set at 0°.

6. A sheet-fed printing press comprising a treatment section that includes a cylinder having a gripper for gripping each of oncoming sheets by a claw block and a claw, and a treatment means for treating said sheet in proximity to or in contact with the surface of said sheet conveyed while being gripped by the gripper to the downstream side in a sheet conveying direction, and plural cylinders disposed between the treatment section and a printing impression cylinder disposed upstream of the treatment section in the sheet conveying direction, each cylinder including a gripper having the same structure as that of said gripper, wherein the gripper of the cylinder of the treatment section is located at a position retracting from an outline of the cylinder, a gripping surface of a claw block of a first cylinder most adjacent to the treatment section, of the plural cylinders, is located at a position projecting through an outline of the first cylinder, a gripping surface of a claw block of a second cylinder upstream of and adjacent to the first cylinder is located at a position retracting from the projecting position of the claw block of the first cylinder, and the projecting or retracting amount of the gripping surface of the claw block of the second or third cylinder closest to the printing impression cylinder is set to be smallest in the projecting or retracting amount of the gripping surface of the claw block of each of the plural cylinders.

* * * * *

UNITED STATES PATENT AND TRADEMARK OFFICE

CERTIFICATE OF CORRECTION

PATENT NO. : 8,210,531 B2
APPLICATION NO. : 12/167965
DATED : July 3, 2012
INVENTOR(S) : Masao Nitta It is certified that error appears in the above-identified patent and that said Letters Patent is hereby corrected as shown below:

Column 15, Line 26, Claim 2, delete “conies” and insert -- comes --

Column 15, Line 43, Claim 2, delete “cylinder is” should read -- cylinder, is --

Signed and Sealed this
Twenty-third Day of October, 2012

David J. Kappos

David J. Kappos
*Director of the United States Patent and Trademark Office*